United States Patent [19]

Fukuoka et al.

[11] Patent Number: 4,488,656

[45] Date of Patent: Dec. 18, 1984

[54] STOPPER FOR VIALS

[75] Inventors: Hisatomi Fukuoka, Kitakatsuragi; Hisami Yamaguchi, Nishinomiya, both of Japan

[73] Assignee: Fujisawa Pharmaceutical Co., Ltd., Osaka, Japan

[21] Appl. No.: 500,570

[22] Filed: Jun. 2, 1983

[30] Foreign Application Priority Data

Jun. 25, 1982 [JP] Japan ..... 57-110393

[51] Int. Cl.[3] ..... B65D 51/16

[52] U.S. Cl. ..... 215/307; 215/355

[58] Field of Search ..... 215/307, 355

[56] References Cited

U.S. PATENT DOCUMENTS 2,649,090 8/1953 Parsons et al. ..... 215/355 X

FOREIGN PATENT DOCUMENTS 1429002 1/1966 France ..... 215/355

982744 2/1965 United Kingdom ..... 215/307

*Primary Examiner*—Donald F. Norton

*Attorney, Agent, or Firm*—Oblon, Fisher, Spivak, McClelland & Maier

[57] ABSTRACT

A stopper for a vial has a top portion and legs extending therefrom. The free or distal end of the legs have cut outs on each of the circumferential sides. The cut outs can be either straight or curved and are of such a size that the stopper can be securely held when partially fitted in a vial. The cut outs prevent the stoppers from becoming entangled during pre-treatment.

4 Claims, 11 Drawing Figures

STOPPER FOR VIALS

BACKGROUND OF THE INVENTION

1. Field of the Invention

The present invention relates to a stopper for vials for pharmaceutical injection preparations and the like.

2. Description of the Prior Art

In recent years, freeze-dried preparations are frequently used as medicinal drugs for injection. FIGS. 1 to 3 show a conventional stopper which is used for vials for containing such preparations, wherein FIG. 1 is a front view of the same, FIG. 2 is a side elevation of the same, and FIG. 3 is a bottom view of the same.

The stopper is partially fitted into the opening of a vial (V) filled with the medicinal solution (S) to be freeze-dried as shown in FIG. 4. The solution within the vial is freeze-dried in this state, and the vial is evacuated or the air in the interior of the vial is replaced by nitrogen gas. Since the stopper must be held stably and partially fitted in during the freeze-drying step and the nitrogen gas replacement step, the legs to be inserted into the opening of the vial are invariably elongated and adapted to have a large area of engagement with the inner wall surface of the vial opening portion.

Because the stopper is used for vials containing medicinal preparations for injection, it is deliberately washed, sterilized and dried before use. However, when a large quantity of stoppers are subjected to these treatments all together, the legs of the stopers are very likely to become entangled as seen in FIG. 5. If the stoppers are sterilized and dried with their legs thus entangled with one another, the legs are semi-permanently deformed by heating in the course of the treatment. Further if they are stored with entangled legs for a considerable period of time before use, semi-permanent deformation will also result.

When the stoppers to be fed to the partial fitting process include such deformed stoppers, the deformed stoppers are likely to jam the feed path, or it becomes impossible to use an automatic machine for this process.

SUMMARY OF THE INVENTION

The present invention has as its object to provide a stopper which has the function of conventional stoppers and which is nevertheless free from the foregoing troubles.

The stopper of the present invention has a structure wherein the legs thereof to be inserted into the opening of a vial have cut outs at the widthwise opposite sides of their free ends.

BRIEF DESCRIPTION OF THE DRAWINGS

Various other objects, features and attendant advantages of the present invention will more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
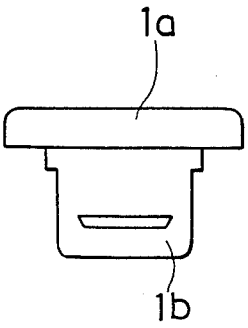
FIG. 1 is a front view of a conventional stopper.
Figure 2:
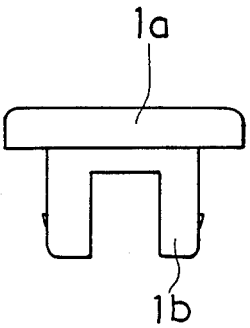
FIG. 2 is a side view of a conventional stopper.
Figure 3:
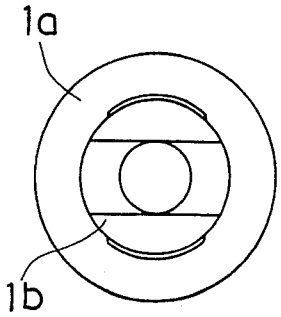
FIG. 3 is a bottom view of a conventional stopper.
Figure 4:
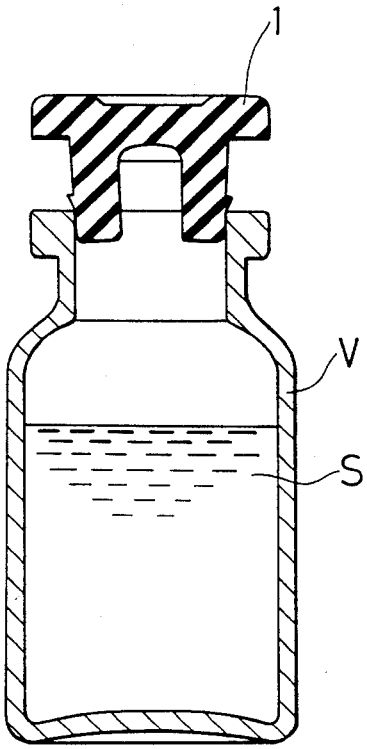
FIG. 4 is a sectional view of a conventional stopper partially fitted in a vial.
Figure 5:
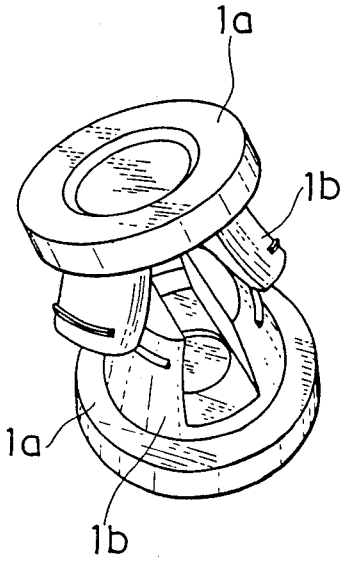
FIG. 5 is a view illustrating two entangled conventional stoppers.
Figure 6:
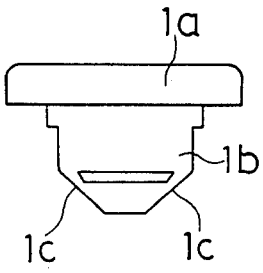
FIG. 6 is a front view showing an embodiment of the stopper of the invention.
Figure 7:
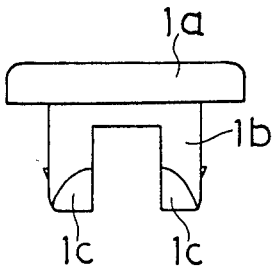
FIG. 7 is a side elevation of the stopper of FIG. 6.
Figure 8:
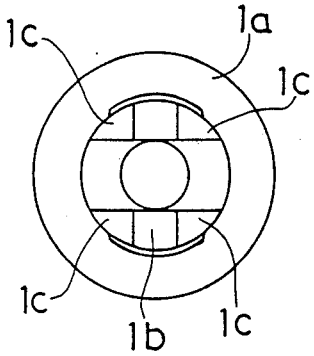
FIG. 8 is a bottom view of the stopper of FIG. 6 same.
Figure 9:
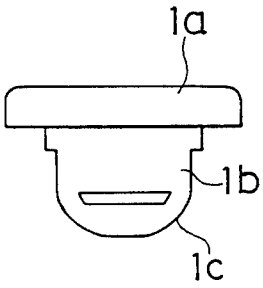
FIG. 9 is a front view of a second embodiment of the stopper of the invention.
Figure 10:
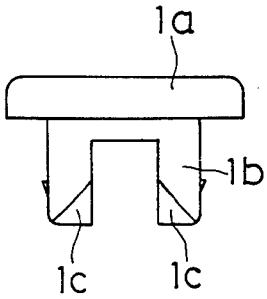
FIG. 10 is a side elevation of the stopper of FIG. 9.
Figure 11:
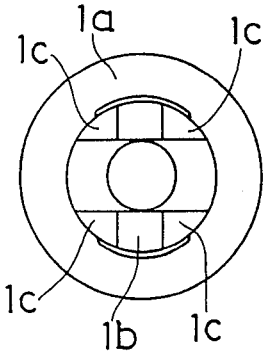
FIG. 11 is a bottom view of the stopper of FIG. 9.

The stopper 1, like conventional stoppers, comprises a top portion 1*a* and legs 1*b* and has generally the same size as the conventional one, but differs therefrom in that the free or distal end of each leg 1*b* has cutouts 1*c* forming surfaces at the widthwise opposite sides thereof. It is desirable to make the cutouts 1*c* as large as possible, i.e., to reduce the surface area of the leg 1*b*, so long as the stopper can be securely held when partially fitted in the vial. The cutout 1*c* is not limited to the planar form shown in FIGS. 6 to 8 but can be shaped to form a curved surface as shown in FIGS. 9 to 11. Further although unillustrated, the cutout may be L-shaped when seen from the front. Thus the shape of the cutout can be modified as desired provided that the object of the invention can be fulfilled.

With the stopper of the present invention, the legs are cut out at the widthwise opposite sides of their free ends and therefore have a decreased surface area and an exceedingly reduced likelihood of entanglement. For example, 5000 conventional stoppers and the same number of stoppers of the invention (of the structure shown in FIGS. 6 to 8) were tested by placing each group of stoppers into the vibration feeder of a full-automatic stopper fitting machine, operating the machine for 15 minutes and thereafter counting the number of pairs of the stoppers remaining in the feeder and having legs entangled with each other. The count was 137 in the case of the conventional stoppers, whereas no entanglement occurred with those of the invention.

The stopper of the present invention has another advantage in that the legs, which have cutouts at their free ends, smoothly advance into the opening of the vial when partially fitting in and therefore raise a greatly reduced likelihood of improper fitting. When the conventional and present stoppers were tested for partial fitting using 4500 vials for each type, 81 vials were found unacceptable in the conventional case, whereas the corresponding count for the stopper of the invention (shown in FIGS. 6 to 8) was as small as only 4.

Additionally the stopper of the invention has an outstanding advantage in respect of savings in resources because the large cutouts at the leg ends assure a corresponding saving in the material.

Although the cutouts at the leg ends result in the great advantages described above, it was thought that the stopper of the invention would not be effectively retained in the partial fitting position. Unexpectedly, however, the present stopper has been found in no way different from the conventional one in this respect.

What is claimed as new and desired to be secured by Letters Patent of the United States is:

1. A stopper for a vial, comprising:

a top portion;

an annular element extending from said top portion, said annular element having a cylindrical radially outer surface, a cylindrical radially inner surface, a longitudinal axis common to both said outer and inner surfaces, one end fixed to said top portion and a distal end opposite said one end;

a slot in said annular element, said slot formed by two parallel planar surfaces extending parallel to said longitudinal axis, each said parallel surface extending to said distal end, intersecting said inner surface and intersecting said outer surface at two points, whereby said annular element is divided into two legs by said slot, each said leg having a first circumferential width and circumferential ends defined by an intersection of said slot and said outer surface; and two cut outs in each said leg, each said cut out being positioned only at an intersection of one said circumferential end and said distal end and defining a surface which intersects said outer surface, one said slot surface and said distal end, wherein said distal end has a circumferential width less than said first width end.

2. The stopper of claim 1 wherein said cut outs each define a planar surface which is non-parallel with said slot surfaces and said distal end.

3. The stopper of claim 1 wherein said cut outs each define a curved non-annular surface which intersects said outer surface at an edge.

4. The stopper of claim 1 wherein said cut outs are of a maximum size which leaves a sufficient size for said legs such that said stopper will be securely held when partially fitted in said vial.

* * * * *